US006516823B1

(12) United States Patent
Glover et al.

(10) Patent No.: US 6,516,823 B1
(45) Date of Patent: Feb. 11, 2003

(54) PLAYYARD CANOPY

(75) Inventors: Richard Glover, Greenwood, IN (US); Jerome J. Drobinski, Reading, PA (US)

(73) Assignee: Cosco Management, Inc., Wilmington, DE (US)

( * ) Notice: Subject to any disclaimer, the term of this patent is extended or adjusted under 35 U.S.C. 154(b) by 3 days.

(21) Appl. No.: 09/693,026

(22) Filed: Oct. 20, 2000

Related U.S. Application Data

(60) Provisional application No. 60/160,652, filed on Oct. 21, 1999.

(51) Int. Cl.[7] ..... E04H 15/16; A47D 7/00

(52) U.S. Cl. ..... 135/94; 135/96; 135/125; 135/135; 135/159; 5/97; 5/99.1; 403/170

(58) Field of Search ..... 5/97, 98.1, 99.1; 135/93, 96, 124, 125, 128, 135, 136, 159, 94; 403/167, 170, 217

(56) References Cited

U.S. PATENT DOCUMENTS

| | | | | | |
|---|---|---|---|---|---|
| 312,446 | A | * | 2/1885 | Drake | 135/33.7 |
| 617,415 | A | * | 1/1899 | Eatman | 135/33.7 |
| 2,681,659 | A | | 6/1954 | Hrinsin | |
| 2,958,084 | A | | 11/1960 | Kenney | |
| 4,219,036 | A | * | 8/1980 | Biggs | 135/93 |
| 4,285,354 | A | * | 8/1981 | Beavers | 135/135 |
| 4,478,234 | A | * | 10/1984 | Bester | 135/93 X |
| 4,637,748 | A | * | 1/1987 | Beavers | 403/170 |
| 4,750,509 | A | * | 6/1988 | Kim | 135/135 |
| 4,790,340 | A | | 12/1988 | Mahoney | |
| 4,811,437 | A | | 3/1989 | Dillner et al. | |
| 4,966,178 | A | * | 10/1990 | Eichhorn | 135/125 X |
| 4,981,387 | A | * | 1/1991 | Younjae | 135/135 |
| 5,046,882 | A | * | 9/1991 | Ju | 403/170 |
| 5,069,572 | A | * | 12/1991 | Niksic | 403/170 |
| 5,099,866 | A | | 3/1992 | Solis et al. | |
| 5,279,006 | A | | 1/1994 | Teng | |
| 5,328,286 | A | * | 7/1994 | Lee | 135/135 |
| D366,978 | S | | 2/1996 | Mariol | |
| D367,788 | S | | 3/1996 | Lawhorn | |
| D370,149 | S | | 5/1996 | Stratton | |
| 5,666,986 | A | * | 9/1997 | Fox | 135/135 |
| 5,678,586 | A | * | 10/1997 | Baksh | 135/33.7 |
| D390,730 | S | | 2/1998 | Gerhart et al. | |
| 5,797,695 | A | * | 8/1998 | Prusmack | 403/170 |
| D404,216 | S | | 1/1999 | Gerhart | |
| 5,862,548 | A | | 1/1999 | Gerhart | |
| 5,884,646 | A | * | 3/1999 | Ju | 135/135 |
| 6,123,091 | A | | 9/2000 | Flynn et al. | |
| 6,296,415 | B1 | * | 10/2001 | Johnson et al. | 403/170 |

FOREIGN PATENT DOCUMENTS

| | | | | |
|---|---|---|---|---|
| CA | 755885 | * | 4/1967 | 135/93 |
| GB | 2136845 | * | 9/1984 | 135/135 |

* cited by examiner

*Primary Examiner*—Robert Canfield
(74) *Attorney, Agent, or Firm*—Barnes & Thornburg

(57) ABSTRACT

A canopy for covering the top of a playyard, the canopy comprising a canopy cover, a canopy support adapted to be coupled to a playyard and configured to support the canopy cover, the canopy support includes a rod connector and four support rods, each support rod includes an inner end pivotably coupled to the rod connector and an outer end adapted to be coupled to one of four corner pieces included in the playyard to retain the canopy support on the playyard, and the rod connector includes a connector ring arranged to pass through apertures formed in the inner ends of each support rod to establish a pivot axis of each support rod about the connector ring and about which each support rod is free to pivot relative to the connector ring.

19 Claims, 10 Drawing Sheets

PLAYYARD CANOPY

This application claims priority under 35 U.S.C. 119(e) to U.S. Provisional Application Ser. No. 60/160,652, filed Oct. 21, 1999, which is expressly incorporated by reference herein.

BACKGROUND AND SUMMARY OF THE INVENTION

The present invention relates to playyards in which small children can be placed, and particularly to a separate playyard canopy that mounts to the top of a playyard frame to cover the playyard. More particularly, the present invention relates to a collapsible canopy for mounting on a playyard and folding between a collapsed storage configuration and an opened playyard-covering configuration.

Playyards in which small children can be placed are well known. Playyards are typically configured as cubicles having a floor panel and side panels extending upwardly therefrom to confine the child within the playyard so that the child is prevented from wandering away from the playyard. Some conventional playyards are collapsible allowing the playyard to be folded from an opened playyard configuration to a collapsed compact storage configuration. See, for example, U.S. Pat. Nos. 5,279,006 to Teng and 4,811,437 to Dillner et al.

Playyards usually have open tops so that a person attending to the child can place the child into and remove the child from the playyard easily. In addition, the side panels of conventional playyards are usually somewhat transparent so that the person attending to the child can see into the playyard to observe the activities of the child and so that the child can see out of the playyard to observe the surrounding environment. When a playyard is exposed to direct sunlight, the open top permits the sunlight to shine into the playyard potentially making the child contained in the playyard uncomfortable. The open top of the playyard also permits other objects to enter the playyard.

Playyard covers that can be attached to the playyard to cover the open top of the playyard are known. See, for example, U.S. application Ser. No. 08/940,909, filed Sep. 30, 1997 and U.S. Pat. Nos. 2,681,659; 4,790,340; 5,862,548; 5,099,866; 2,958,084; Des. 370,149; Des. 404,216; Des. 390,730; Des. 367,788; and Des. 366,978 and the HAPPY CABANA™ Play Yard disclosed in the Evenflo 1995 Baby Products Catalog at page 12, which disclosures are hereby incorporated by reference herein.

A canopy in accordance with the present invention is provided to cover the top of a playyard. The canopy includes a canopy cover and a canopy support adapted to be coupled to a playyard and configured to support the canopy cover. The canopy support includes a rod connector and several support rods. Each support rod has an inner end pivotably coupled to the rod connector and an outer end adapted to be coupled to one of the corner pieces included in the playyard so as to retain the canopy support on the playyard and position the canopy cover over the playyard.

In preferred embodiments, the rod connector includes a connector ring arranged to pass through apertures formed in the inner ends of each support rod and a rod mount configured to support the connector ring. The inner end of each support rod lies in a slot formed in the rod mount and is free to pivot about a portion of the connector ring which passes through that slot. Thus, the support rods are able to pivot about the connector ring from a spread configuration arranged to support the canopy cover above a set-up playyard to a collapsed configuration arranged to be stored in a space provided in a collapsed playyard.

In other embodiments, the canopy also includes a vent tower coupled to a top portion of the canopy cover and the canopy support also includes a collapsible tower frame coupled to the several support rods and configured to support the vent tower above the canopy cover. The vent tower includes a ceiling and a mesh side wall.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
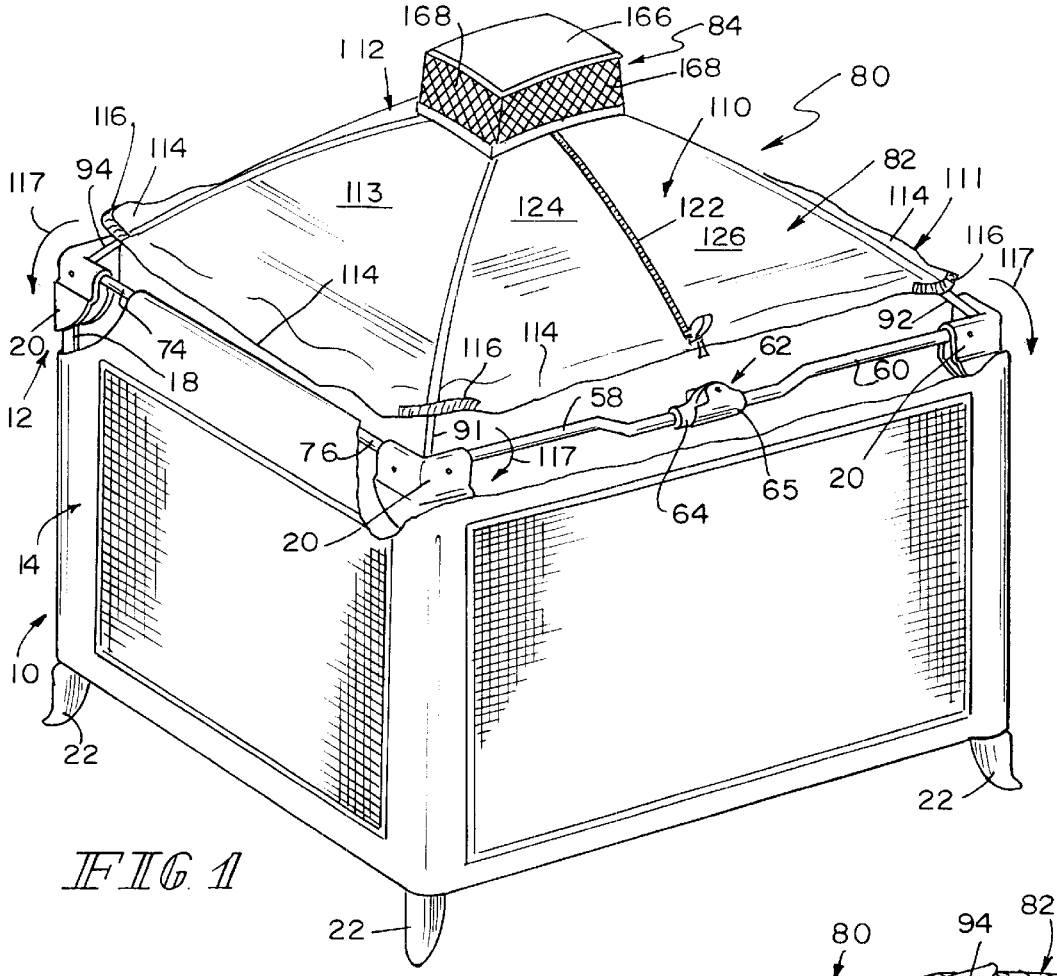
FIG. 1 is a perspective view of a playyard canopy in accordance with the present invention showing the playyard canopy mounted on a playyard and positioned to lie above the top opening of the playyard and showing elastic bands at each corner of the fabric canopy cover before those corners and elastic bands are pulled down over corners of the underlying playyard.
Figure 2:
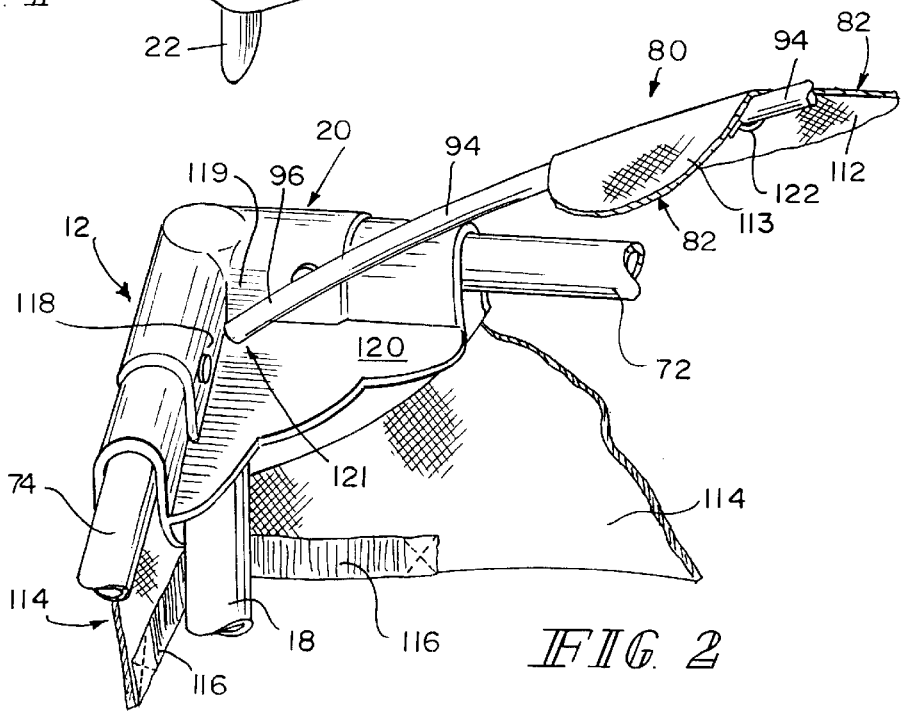
FIG. 2 is an enlarged perspective view of a portion of the left rear corner of the playyard of FIG. 1 showing engagement of an outer end of a canopy support rod with one of the corners of the playyard and showing the position of one of the elastic bands relative to the playyard frame when the canopy is mounted on the playyard.
Figure 3:
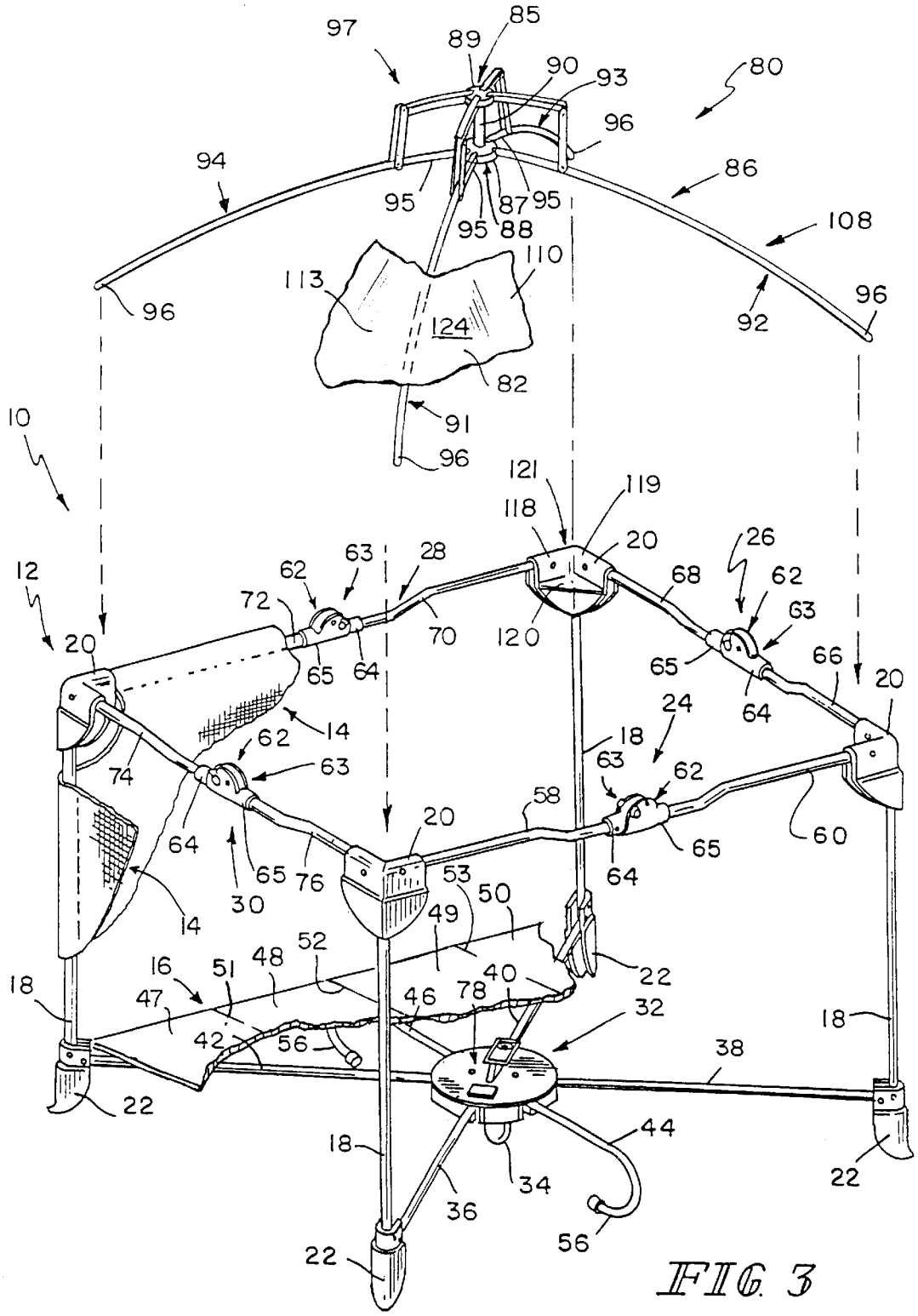
FIG. 3 is a perspective view similar to FIG. 1, with portions broken away, showing the playyard frame and floor and showing the canopy support and a small piece of the fabric canopy cover prior to installation of the canopy on the underlying playyard.
Figure 7:
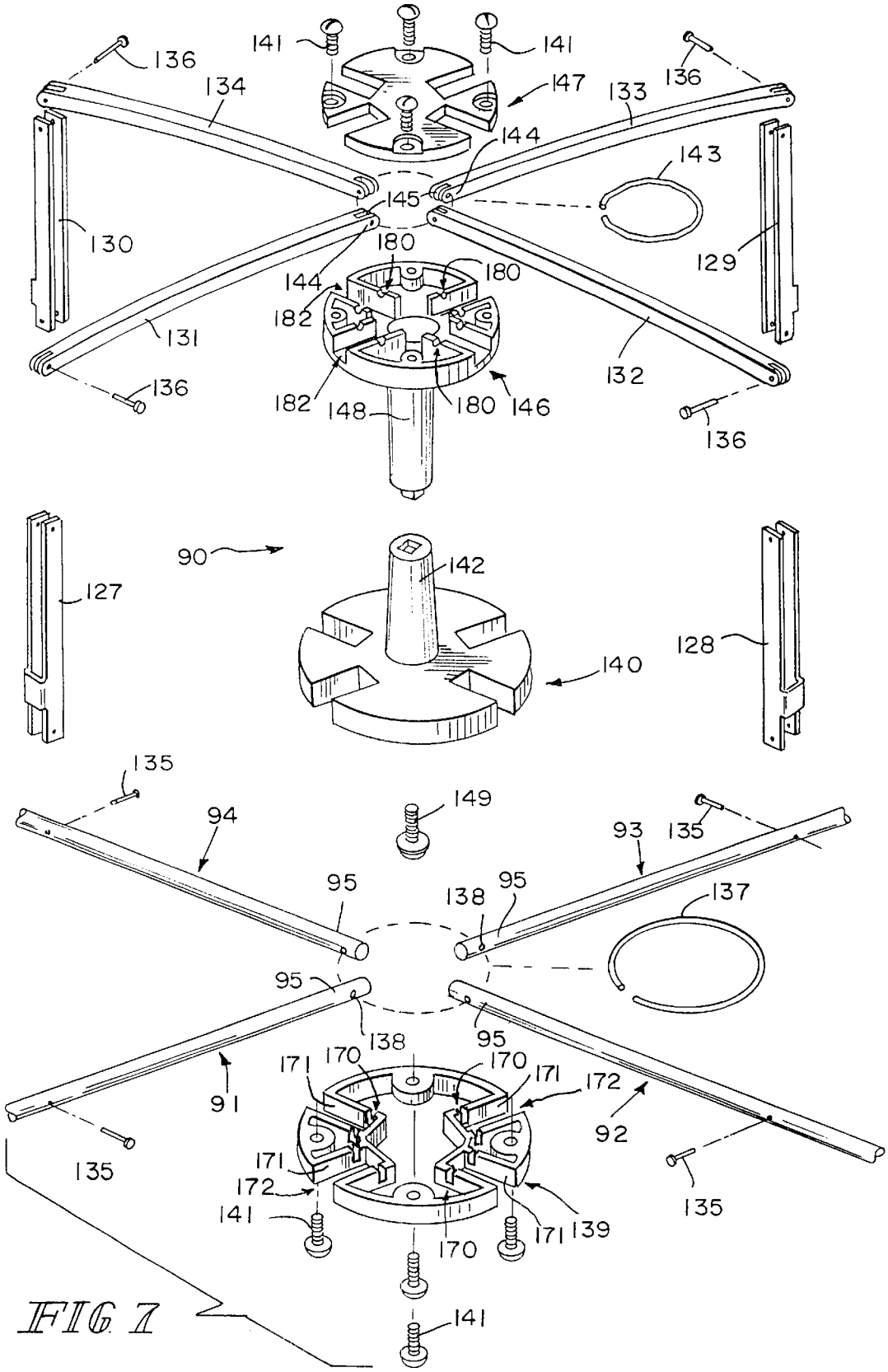
FIG. 7 is an exploded perspective view of components that can be assembled to produce the canopy support illustrated in FIG. 3.

Playyard 10 includes a collapsible frame 12, fabric frame cover 14, and removable floor mat 16. A collapsible playyard canopy 80 is provided for covering the top of playyard 10 as shown in FIG. 1. Canopy 80 includes a fabric canopy cover 82, a fabric vent tower 84 coupled to a top portion of canopy cover 82, and a canopy support 86 adapted to be coupled to playyard 10 as shown in FIGS. 1–3 and configured as shown in FIGS. 2, 3, and 7 to support canopy cover 82 and vent tower 84. When not in use, canopy 80 can be collapsed and stored in the collapsed playyard 10 as shown, for example, in FIGS. 9 and 10.

Figure 4:
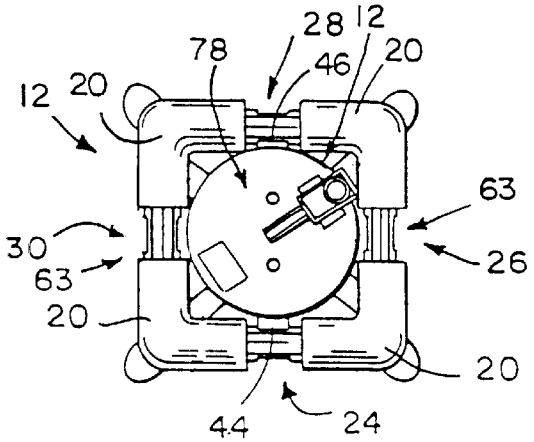
FIG. 4 is a top plan view of the playyard of FIG. 3 after the floor mat has been removed and the playyard frame has been fully collapsed.
Figure 5:
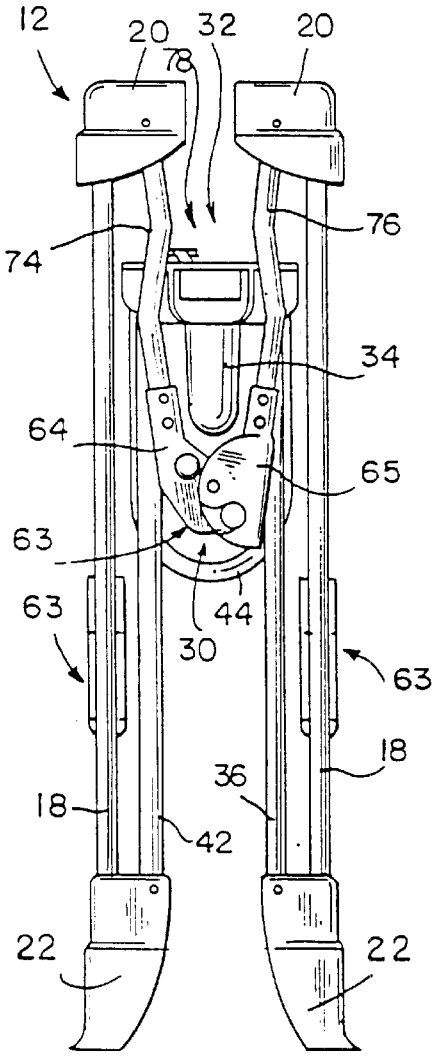
FIG. 5 is a side elevation view of the fully collapsed playyard frame of FIG. 4.
Figure 6:
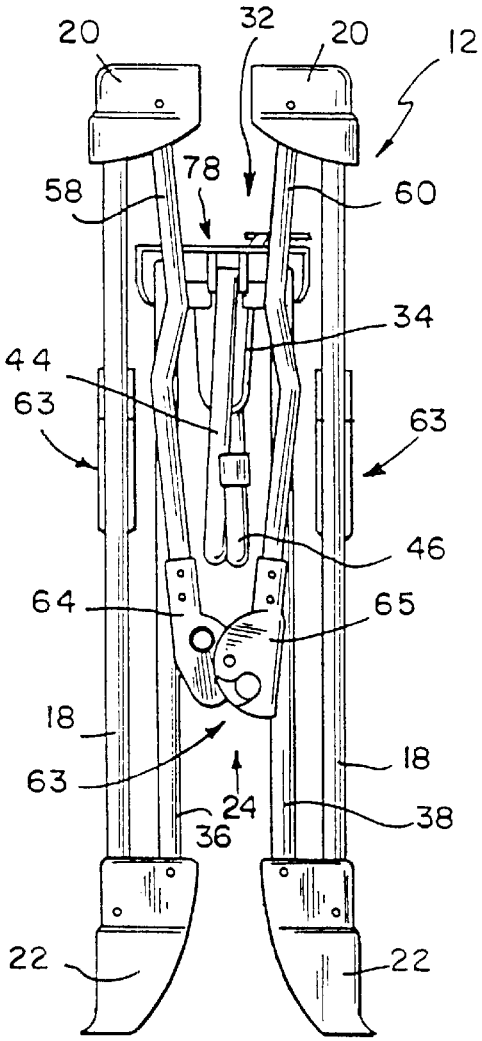
FIG. 6 is an end elevation view of the fully collapsed playyard frame of FIG. 4.

Frame cover 14 is made of sturdy fabric and netting material and is foldable to enable frame 12 to be moved easily from an erected configuration shown in FIGS. 1 and 2 to a collapsed configuration shown in FIGS. 4–6. Floor mat 16 and canopy 80 are removed from frame 12 prior to collapsing frame 12. Once frame 12 is collapsed, the four-segment floor mat 16 can be folded, "wrapped" around collapsed frame 12, and secured using straps (not shown) to provide a "case" for storing and/or carrying collapsed frame 12. Canopy 80 can be collapsed as shown, for example, in FIG. 9 and then stowed in collapsed playyard 10 as shown, for example, in FIG. 10.

As shown, for example, in FIG. 3, canopy support 86 includes a rod connector 88, a leg connector 89, a tower post 90 arranged to interconnect rod and leg connectors 88 and 89, and first, second, third, and fourth support rods 91, 92, 93, and 94. Each one of the support rods has an inner end 95 coupled to rod connector 88 and an outer end 96 adapted to be coupled to one of the playyard corner pieces 20 as suggested in FIG. 3 and shown, for example, in FIG. 2. Support rods 91, 92, 93, and 94 cooperate with rod connector 88 to form a canopy frame 108 included in canopy support 86 and configured to support canopy cover 82 above playyard floor 16. Canopy support 86 further includes a tower frame 97 that is coupled to leg connector 89 and support rods 91, 92, 93, 94 and arranged to support vent tower 84 above canopy cover 82. Canopy support 86 is collapsible as shown, for example, in FIGS. 9 and 10 once canopy 80 has been removed from playyard 10 for easy storage in the collapsed playyard 10 or elsewhere. It is within the scope of this disclosure to make the outer diameter of rod connector 88 equal to or less than the outer diameter of leg connector 89.

Collapsible frame 12 includes four corner legs 18, a corner piece 20 at the top end of each corner leg 18, and a corner foot 22 at the bottom end of each corner leg 18. Frame 12 also includes a foldable top rail 24, 26, 28, or 30 interconnecting each pair of adjacent corner pieces 20. Frame 12 further includes a rail mount 32, a foot 34 for elevating rail mount 32, and a support rail 36, 38, 40, or 42 interconnecting rail mount 32 and each of the corner feet 22. Frame 12 also includes two auxiliary support rails 44, 46 coupled to rail mount 32.

Floor mat 16 includes four sections 47, 48, 49, and 50 arranged in series as shown in FIG. 3. Section 47 is coupled to section 48 at fold line 51, section 48 is coupled to section 49 at fold line 52, and section 49 is coupled to section 50 at fold line 53. Floor mat 16 can be "unrolled" to assume a flat configuration and then dropped in place as shown in FIG. 3 to provide a sturdy playyard floor supported in an elevated position above the ground 54 underlying playyard 10 by rail mount 32 and support rails 36, 38, 40, 42, 44, and 46.

Each of support rails 36, 38, 40, and 42 has an outer end pivotably coupled to one of the corner feet 22 and an inner end pivotably coupled to rail mount 32 so as to facilitate collapsing movement of frame 12 from its erected configuration shown in FIGS. 1 and 3 to its collapsed configuration shown in FIGS. 4–6. Each of auxiliary support rails 44 and 46 has an inner end pivotably coupled to rail mount 32 and an outer end formed to define a rail support foot 56 as shown, for example, in FIG. 3. Once assembled, support rails 36, 38, 40, and 42 are arranged to lie in an X-shaped pattern, auxiliary support rail 44 is arranged to bisect the included angle defined by support rails 36 and 38, and auxiliary support rail 46 is arranged to bisect the included angle defined by support rails 40 and 42.

Front top rail 24 includes a left rail segment 58 pivotably coupled to one of the corner pieces 20, a right rail segment 60 coupled for pivotable movement relative to left rail segment 58 (in, for example, the manner described below) and to an adjacent corner piece 20, and a releasable segment lock 62 configured and mounted to "lock" the left and right rail segments 58, 60 together in an in-line relation one to another as shown, for example, in FIGS. 1 and 3 upon movement of frame 12 to its erected configuration. Releasable segment lock 62 is mounted in a two-piece lock housing 63 having a left portion 64 rigidly coupled to left rail segment 58 and a right portion 65 rigidly coupled to right rail segment 60 and pivotably coupled to left portion 64.

Releasable segment lock 62 is mounted in a two-piece portion 63 having a left portion 64 rigidly coupled to left rail segment 58 and a right portion 65 rigidly coupled to right rail segment 60 and pivotably coupled to left portion 64. Left rail segment 58 and left portion 64 (of lock housing 63) cooperate to form a left rail of front top rail 24. Right rail segment 60 and right portion 65 (of lock housing 63) cooperate to form a right rail of front top rail 24.

Each of right-side top rail 26, rear top rail 28, and left-side top rail is similar in structure to front top rail 24 in that each includes a two-piece lock housing 63 containing a releasable segment lock 62. Right-side top rail 26 includes a left rail segment 66 pivotably coupled to one of the corner pieces 20 and rigidly coupled to a left portion 64 of a second lock housing 63 and a right rail segment 68 pivotably coupled to an adjacent corner piece 20 and rigidly coupled to a right portion 65 of the second lock housing 63. Rear top rail 28 includes a left rail segment 70 pivotably coupled to one of the corner pieces 20 and rigidly coupled to a left portion 64 of a third lock housing 63 and a right rail segment 72 pivotably coupled to an adjacent corner piece 20 and rigidly coupled to a right portion 65 of the third lock housing 63. Left-side top rail 30 includes a left rail segment 74 pivotably coupled to one of the corner pieces 20 and rigidly coupled to a left portion 64 of a fourth lock housing 63 and a right rail segment 76 pivotably coupled to an adjacent corner piece 20 and rigidly coupled to a right portion 65 of the fourth lock housing 63.

A releasable rail lock apparatus 78 is provided in rail mount 32 and configured to lock certain of the support rails 36, 38, 40, 42 to rail mount 32 when frame 12 is in its erected configuration as shown in FIG. 3. Rail lock apparatus 78 is configured to engage each of support rails 36, 40 and thereby block pivoting movement of the support rails 36, 40 relative to rail mount 32 when frame 12 is in its erected configuration as shown in FIG. 3 so as to prevent collapsing movement of frame 12 to its collapsed configuration. Rail lock apparatus 78 is configured to be releasable so that a user, after first removing floor mat 16 to expose rail mount 32, can manually actuate rail lock apparatus 78 to disengage a locked connection established between rail mount 32 and support rails 36, 40, thereby allowing pivoting movement of the now unlocked support rails 36, 40 relative to rail mount 32 as shown, for example, in FIG. 8 during controlled collapse of frame 12.

Figure 9:
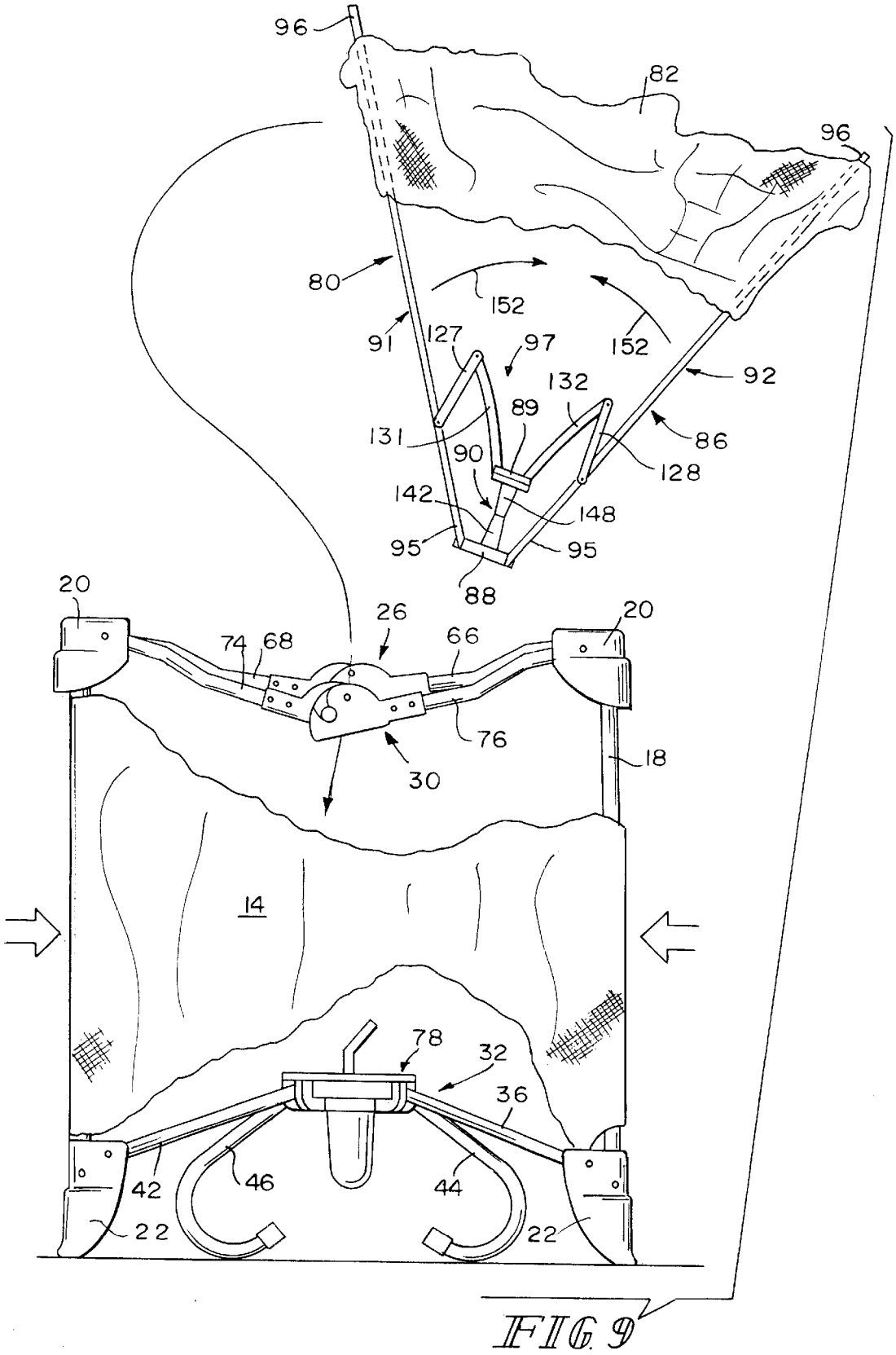
FIG. 9 is an end elevation view of the playyard of FIGS. 1 and 3 as it is being collapsed showing partial collapse of the playyard canopy after it has been removed from the mounted position shown in FIG. 1 and before it is placed in the storage position shown in FIG. 10.

Referring now to FIGS. 3 and 9, playyard 10 can be collapsed by removing canopy 80 and floor mat 16, manually actuating releasable rail lock apparatus 78 and then raising rail mount 32 away from ground 54 to collapse support rails 36, 38, 40, 42, 44, 46 partially, and then manually actuating each of the four releasable segment locks 62 to collapse top rails 24, 26, 28, 30 partially. Then frame 12 can be collapsed further to assume a fully collapsed configuration shown, for example, in FIGS. 4–6. Finally, if desired, collapsed canopy 80 can be stowed in collapsed playyard 10 as shown, for example, in FIGS. 9 and 10 and floor mat 16 can be wrapped around collapsed frame 12 and secured using suitable means to provide a storage case or carrying case for collapsed frame 12.

Referring again to FIG. 1, canopy cover 82 includes front ceiling panel 110, right-side ceiling panel 111, rear ceiling panel 112, and left-side ceiling panel 113. Each of the ceiling panels 110–113 has a trapezoidal shape wherein a long base edge is adapted to extend along one of the top rails 24, 26, 28, 30 of playyard 10 when canopy 80 is mounted on playyard 10, a short top edge abuts a lower edge of vent tower 84, and diagonal edges extend along support rods 91–94 and form boundaries between pairs of adjacent ceiling panels 110–113.

A canopy skirt 114 is defined by the lowest edge of the four ceiling panels 110–113 as shown in FIGS. 1 and 2 and this skirt 114 includes the long base edge of each of the four ceiling panels 110–113. An elastic band 116 is coupled to each corner portion 118 of canopy skirt as shown in FIGS. 1 and 2. Canopy skirt 114 and elastic bands 116 cooperate to help retain canopy 80 in a mounted position on playyard 10 as shown in FIG. 2 once canopy skirt 114 and elastic bands 116 have been pulled down in directions 117 over playyard corner pieces 20 and playyard top rails 24, 26, 28, 30 as suggested in FIG. 1.

When mounted on playyard 10, the outer end 26 of each canopy support rod 91–94 is arranged to engage one of the playyard corner pieces 20 as suggested in FIGS. 1 and 2 to help retain canopy 80 in its mounted position on playyard 10. As shown in FIG. 2, corner piece 20 includes upright walls 118 and 119 and a rod base 120 coupled to upright walls 118, 119 to form an interior corner 111 adapted to receive one of the outer ends 26 of a canopy support rod 91–94 when canopy 80 is mounted on playyard 10. It is within the scope of this disclosure to form each playyard corner piece 20 to include or to provide on or near each playyard corner piece 20 any suitable rod receiver adapted to receive one of the support rod outer ends 26 to assist in mounting canopy 80 on playyard 10.

A rod sleeve 122 is coupled to canopy cover 82 along the boundary between each pair of adjacent ceiling panels and sized to receive one of the canopy support rods 91–94 therein to couple canopy cover 82 to canopy support 86. As shown, for example, in FIG. 2, a rod sleeve 122 is provided along the boundary between rear ceiling panel 112 and left-side ceiling panel 113 to receive fourth rod support 94 therein. Rod sleeve 122 is sized to permit a rod support to slide therein during installation and removal of canopy 80 on and from playyard 10. It is within the scope of this disclosure to use any suitable clip, tie-down, ring, channel, or other connector to couple rod supports 91–94 to canopy cover 82.

Canopy cover 82 is configured to be opened to permit a child caregiver to gain access into playyard 10 when canopy 80 is mounted on top of playyard 10. A zipper connector 122 is provided to join adjacent flaps 124, 126 included in front ceiling panel 110 of canopy cover 82. It is within the scope of this disclosure to provide one or more zipper or other connectors to join flaps included in one or more of the canopy ceiling panels 91–94.

Components included in canopy support 86 are shown, for example, in FIG. 7. Canopy support 86 includes a canopy frame 108 and a tower frame 97 coupled to canopy frame 108 and arranged to extend upwardly from canopy frame 108 as shown, for example, in FIGS. 3 and 7. Canopy frame 108 includes support rods 91–94 and rod connector 88. Tower frame 97 includes four side legs 127, 128, 129, 130 and four top legs 131, 132, 133, 134 and a leg connector 89. The lower end of each side leg 127–130 is pivotably coupled to the canopy frame 108, e.g., to one of support rods 91–94 using a pivot pin 135 and an outer end of each top leg 131–134 is pivotably coupled to an upper end of each side leg 127–130 using a pivot pin 136.

Vent tower 84 includes a fabric tower ceiling 166 and four mesh tower side walls 168. The lower edges of tower side walls 168 are coupled to canopy cover 82 as shown, for example, in FIG. 1 and can be detachable from canopy cover 82. Canopy cover 82 is supported by canopy frame 108 and vent tower 84 is supported by tower frame 97.

Rod connector 88 in the canopy frame 108 of canopy support 86 includes a connector ring 137 adapted to pass through apertures 138 formed in inner ends 95 of each support rod 91–94 as suggested in FIG. 7. Rod connector 88 further includes a rod mount 87 including a base plate 139 and a top plate 140 adapted to be coupled to base plate 139 using bolts 141 to support inner ends 95 of support rods 91–94 for pivotable movement about portions of connector ring 137 in between base and top plates 139, 140. A bottom portion 142 of tower post 90 is coupled to a top surface of top plate 140.

Base plate 139 is formed to include a series of notches 170 sized and arranged to receive connector ring 137 therein. As shown, for example in FIG. 7, base plate 139 includes four pairs of side walls 171 and each side wall 171 is formed to include one of the notches 170. The side walls 171 in each pair of side walls 171 are arranged to lie in spaced-apart relation to one another to define a slot 172 therebetween sized to receive an inner end 95 of one of the pivotable support rods 91–94 therein. In one embodiment, notches 170 are arranged in a "ring" as shown in FIG. 7. It is within the scope of this disclosure to form all or part of notches 170 in the top plate 140.

Leg connector 89 in tower frame 97 of canopy support 86 includes a connector ring 143 adapted to pass through apertures 144 formed in inner ends 145 of each top leg 131–134 as suggested in FIG. 7. Leg connector 89 further includes a leg mount 85 including a base plate 146 and a top plate 147 adapted to be coupled to base plate 146 using bolts 141 to support inner ends 145 of top legs 131–134 for pivotable movement about portions of connector ring 143 in between base and top plates 146, 147. A top portion 148 of tower post 90 is coupled to a bottom surface of bottom plate 146 and coupled to bottom portion 142 using a connector 149 to form tower post 90.

Base plate 146 is formed to include a series of notches 180 sized and arranged to receive connector ring 143 therein. As shown, for example in FIG. 7, base plate 146 includes four pairs of side walls 181 and each side wall 181 is formed to include one of the notches 180. The side walls 181 in each pair of side walls 181 are arranged to lie in spaced-apart relating to one another to define a slot 182 therebetween sized to receive an inner end 145 of one of the pivotable top legs 131–134. In one embodiment, notches 180 are arranged in a "ring" as shown in FIG. 7. It is within the scope of this disclosure to form all or part of notches 180 in top plate 147.

Figure 8:
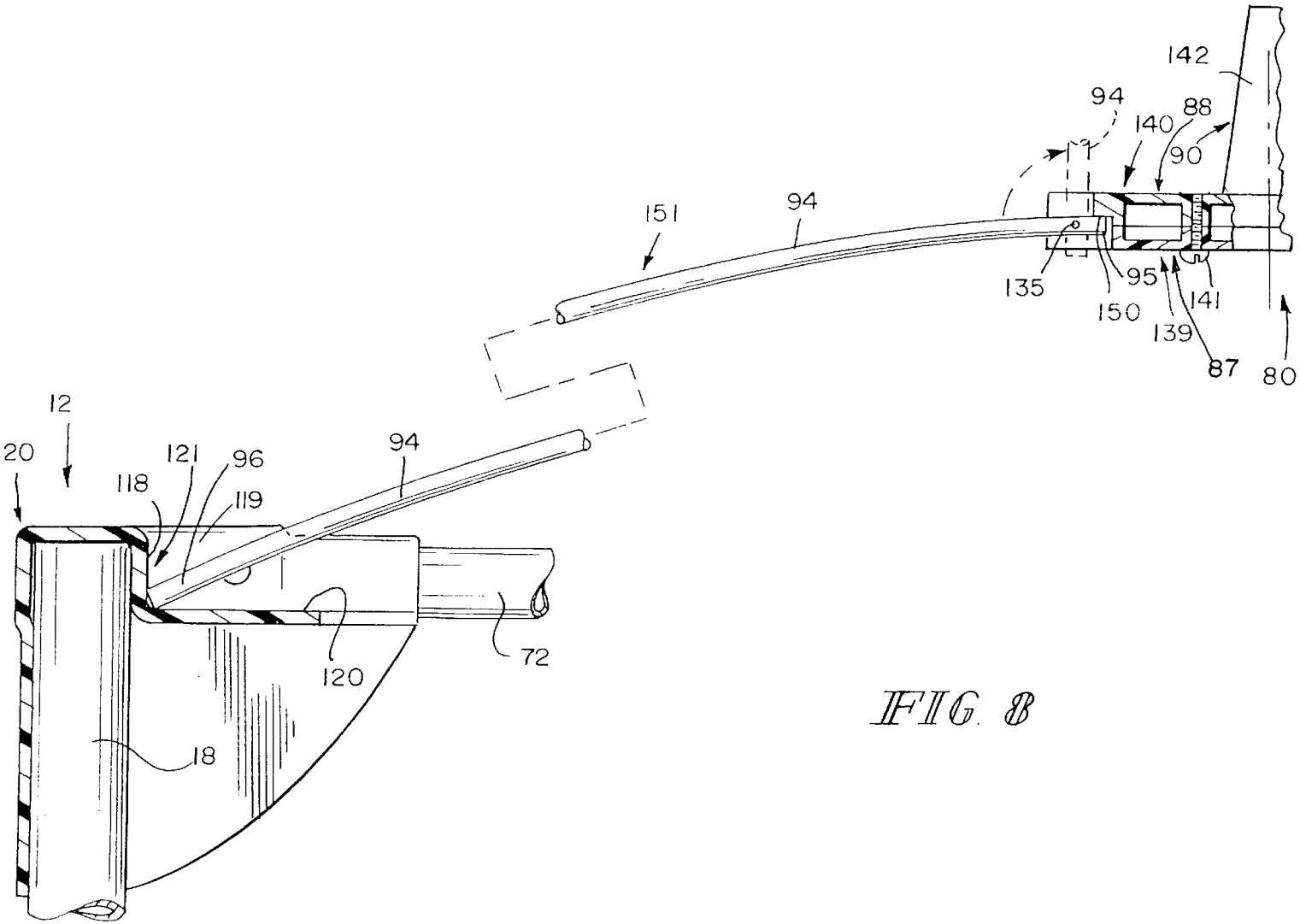
FIG. 8 is a sectional view through the left-side corner of the playyard and the canopy support of FIG. 1 showing contact of an outer end of the third support rod against the third playyard corner piece and contact of an inner end of the third support rod against a downwardly facing lip provided in the rod connector of the canopy support.

Canopy 80 is installed on playyard 10 by pivoting support rods 91–94 in canopy support 86 to the positions shown in FIGS. 3 and 8. The inner end 95 of each support rod 91–94 engages a downwardly facing lip 150 provided in rod connector 88 (see lip 150 in FIG. 8) and each support rod 91–94 is "bowed" in direction 151 so that the outer end 96 of each support rod 91–94 is "captured" in the interior corner 121 provided at playyard corner piece 20 as shown in FIG. 8. Lip 150 restrains counterclockwise rotation of the inner end 95 of support rod 94 (as seen in FIG. 8) to allow bowing of the support rod 94 against the rod connector 88; however, clockwise rotation of support rod 94 about pivot 135 to the dotted line position shown in FIG. 8 is allowed during collapse of canopy 80 to the compact storage position.

Once installed, canopy support 86 maintains canopy cover 82 in a position overlying playyard 10 as shown in FIG. 1. Bending of the support rods 91–94 causes canopy support 86 to be held in place by increased force friction between support rods 91–94 and playyard corner pieces 20. Elastic bands 116 on canopy skirt 114 also help to hold canopy 80 in place on playyard 10.

Figure 10:
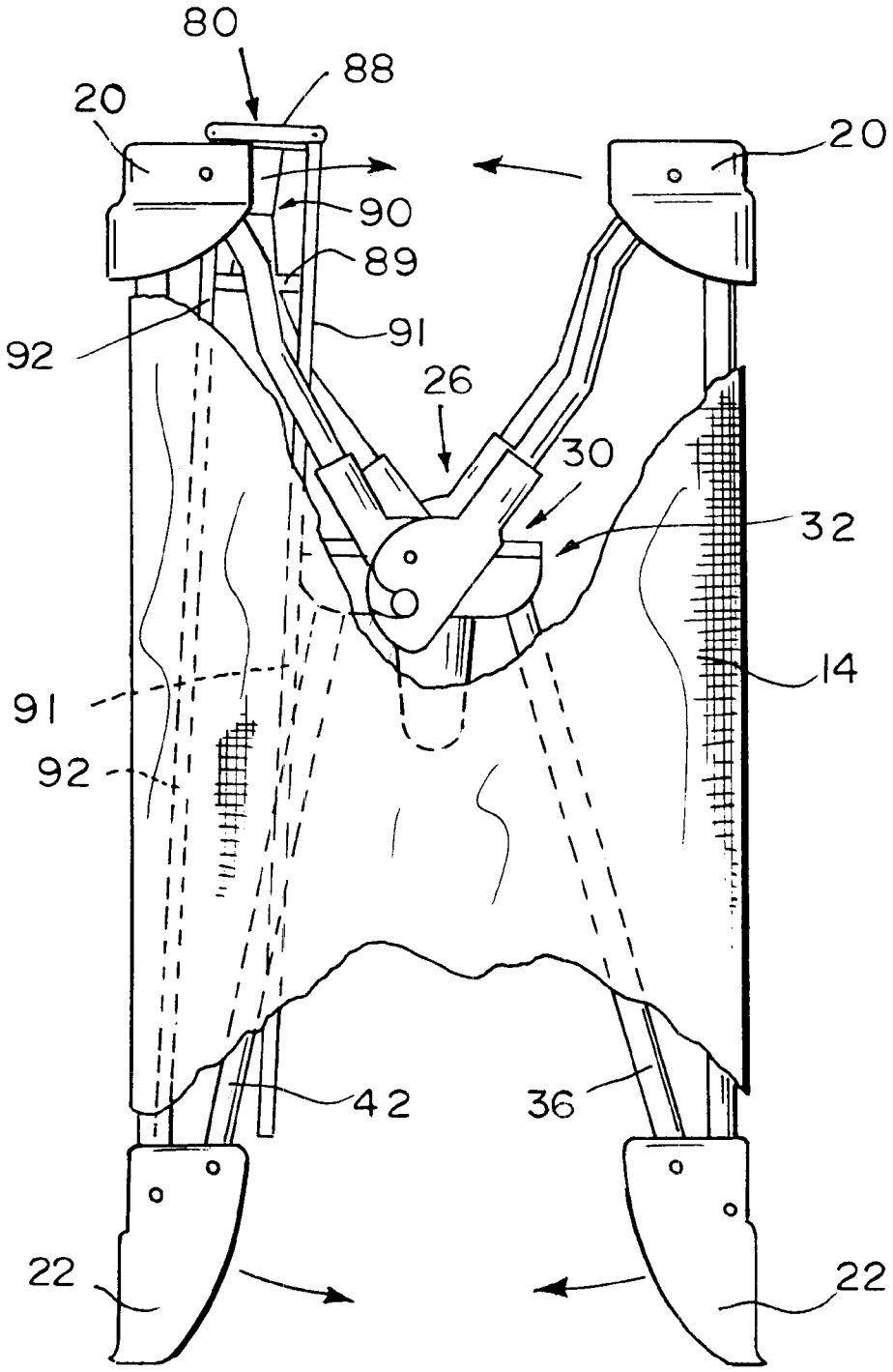
FIG. 10 is a view similar to FIG. 8 showing the position of the fully collapsed playyard canopy after it has been stored in the playyard prior to fully collapsing the playyard to assume the collapsed position shown in FIGS. 4–6.
Figure 11:
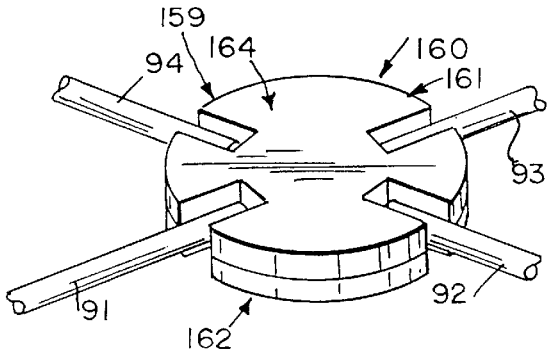
FIG. 11 is a perspective view of another embodiment of a portion of a canopy support including a rod connector and four support rods pivotably coupled to the rod connector.
Figure 12:
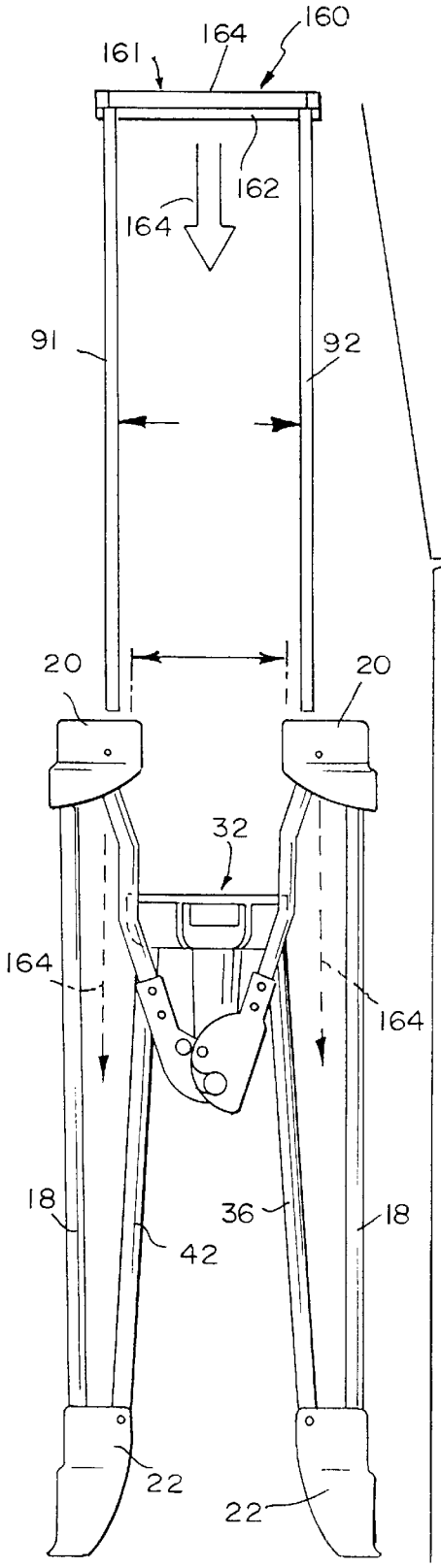
FIG. 12 is a view of a partly collapsed playyard showing insertion of the canopy support of FIG. 11 into an interior space provided in the partly collapsed playyard after complete collapse of the canopy support.

Canopy 80 is removed from playyard 10 by pivoting support rods 91–94 relative to rod connector 88 in directions 152 to assume a partly collapsed configuration as shown in FIG. 9. The canopy 80 is inverted as shown in FIG. 9 and then fully collapsed and inserted into an interior region of the playyard where it assumes a stored position as shown in FIG. 10.

Figure 13:
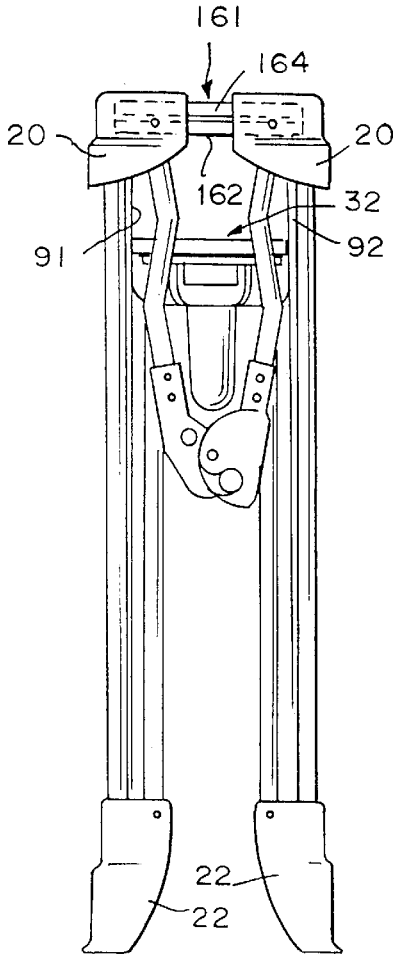
FIG. 13 is a view similar to FIG. 12 showing the canopy support of FIG. 12 in its stored position with the fully collapsed playyard.
Figure 14:
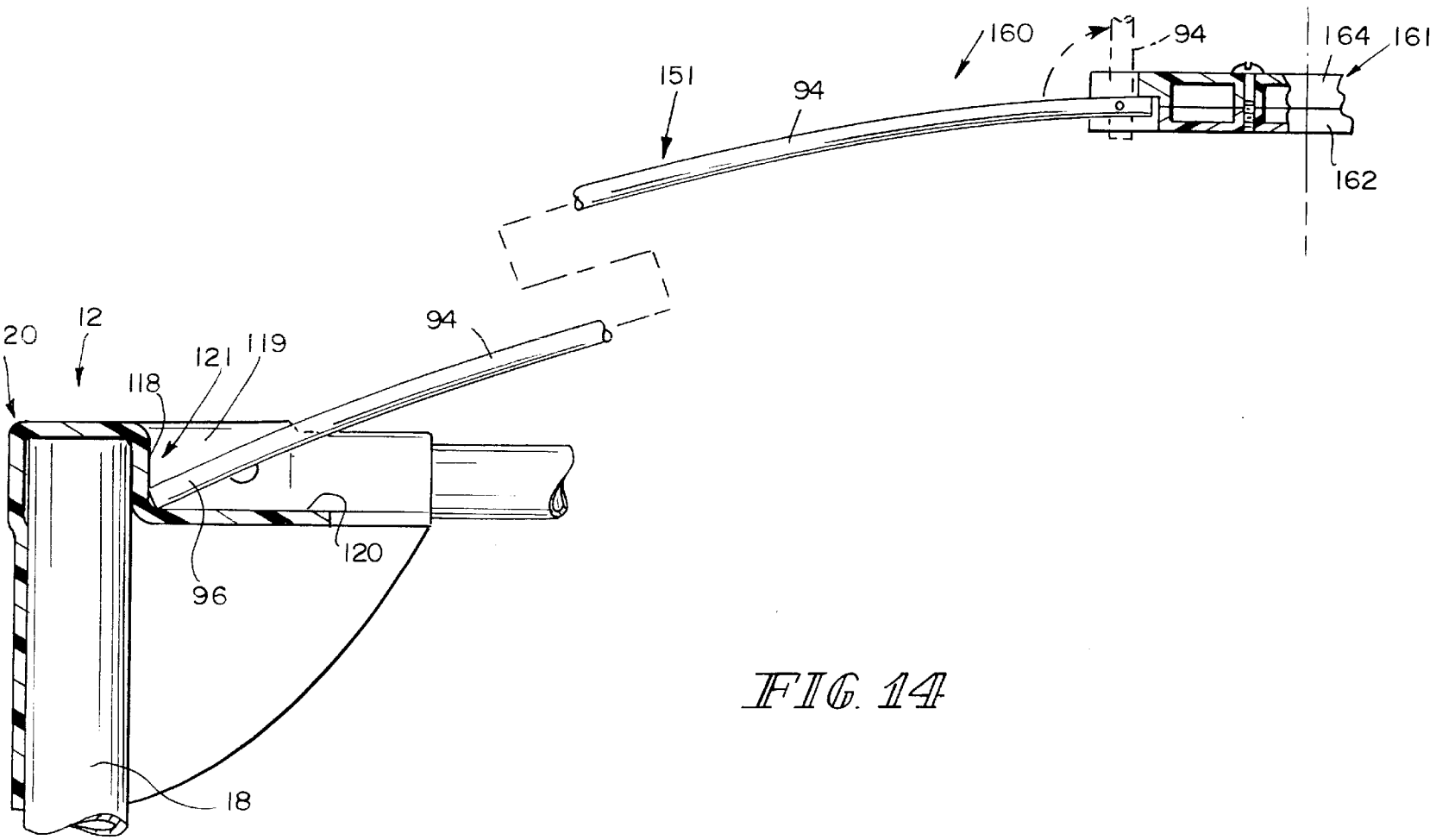
FIG. 14 is a view similar to FIG. 8 of the canopy support of FIG. 11 engaged to a playyard corner piece included in the playyard of FIGS. 1 and 3.
Figure 15:
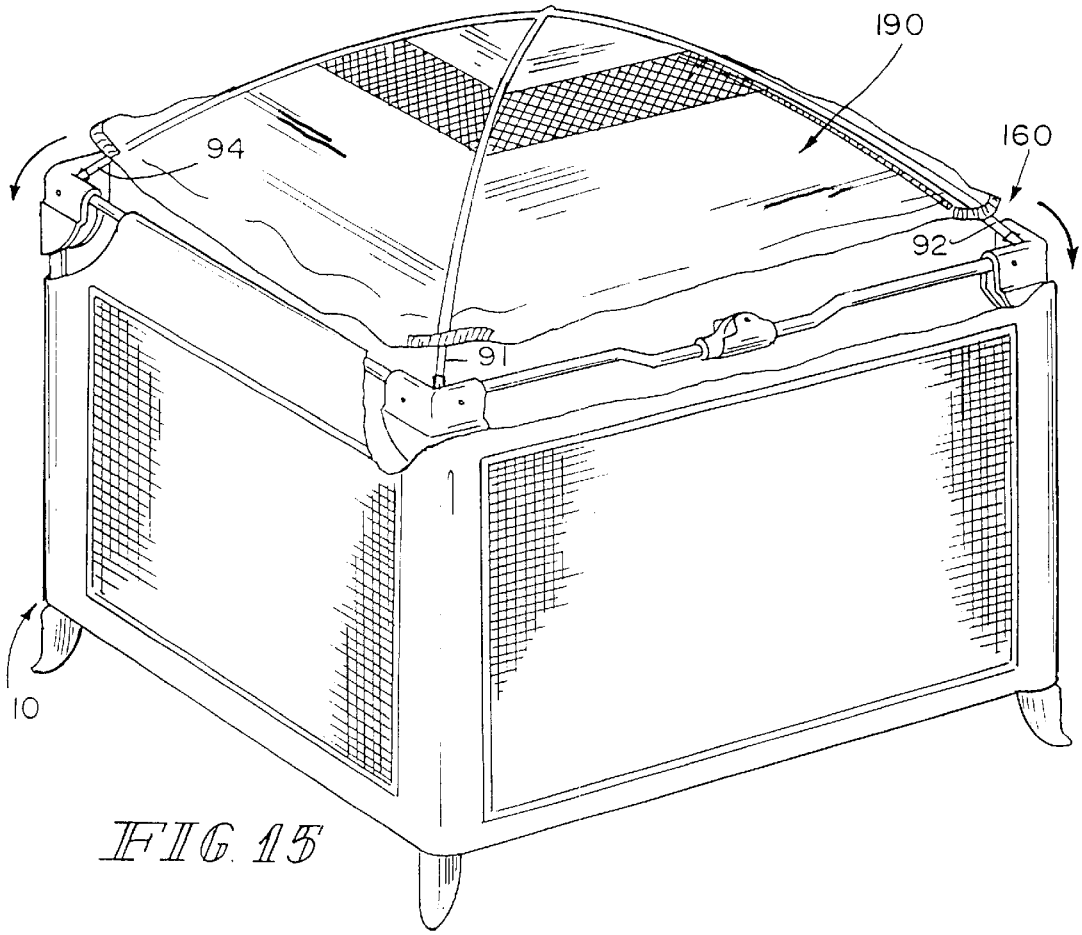
FIG. 15 is a view of the canopy support of FIGS. 11–14 under a canopy cover and coupled to a playyard.

Another canopy support 160 is shown in FIGS. 11–15. Canopy support 160 includes support rods 91–94 and a rod connector 161 including a rod mount 159 including a bottom plate 162, a top plate 164 coupled to bottom plate 162, and pivot apparatus (not shown in detail but including a connector ring and similar to the pivot apparatus shown in FIG. 7) configured to pivotably couple support rods 91–94 to the rod connector 161. To store canopy support 160 (shown in FIGS. 12 and 13 without a canopy cover thereon) in playyard 10, support rods 91–94 are folded relative to rod connector 161 to assume the configuration shown in FIG. 12. The collapsed canopy support 160 is then lowered in direction 163 into the partly collapsed playyard so that rod connector 161 is positioned to lie above rail mount 32 of playyard and the playyard 10 is then moved to its fully collapsed position as shown in FIG. 13. Canopy support 160 is configured to support a canopy cover 190 as shown, for example, in FIG. 15 above playyard 10.

Although the invention has been described in detail with reference to preferred embodiments, variations and modifications exist within the scope and spirit of the invention as described and defined in the following claims.

What is claimed is:

1. A canopy for covering the top of a playyard, the canopy comprising a canopy cover, a vent tower coupled to a top portion of the canopy cover and having a frame including a leg connector, four side legs, and four top legs, a lower end of each side leg is pivotably coupled to the canopy frame, an outer end of each top leg is pivotably coupled to an upper end of a companion side leg, and an inner end of each top leg is pivotably coupled to the leg connector, the vent tower including a ceiling and a mesh side wall, and a canopy support adapted to be coupled to a playyard, including a collapsible canopy frame supporting the canopy cover and a collapsible tower frame coupled to the collapsible canopy frame and arranged to support the vent tower wherein the leg connector includes a leg mount and a connector ring retained in the leg mount and arranged to pass through apertures formed in the inner ends of each top leg to establish a pivot axis of each top leg about the connector ring and about which each top leg is free to pivot relative to the connector ring.

2. A canopy for covering the top of a playyard, the canopy comprising a canopy cover, a canopy support adapted to be coupled to a playyard and configured to support the canopy cover, the canopy support includes a rod connector and four support rods, each support rod includes an inner end pivotably coupled to the rod connector and an outer end adapted to be coupled to one of four corner pieces included in the playyard to retain the canopy support on the playyard, and the rod connector includes a connector ring arranged to pass through apertures formed in the inner ends of each support rod to establish a pivot axis of each support rod about the connector ring and about which each support rod is free to pivot relative to the connector ring.

3. The canopy of claim 2, wherein the rod connector further includes a base plate and a top plate coupled to the base plate to support the inner ends of the support rods for pivotable movement about portions of the connector ring.

4. The canopy of claim 3, wherein the base and top plates cooperate to form a separate slot arranged to receive each of the inner ends of the support rods therein and the slots are arranged to lie in spaced-apart relation to one another about a perimeter edge of the base and top plates.

5. The canopy of claim 3, wherein the base plate is formed to include a plurality of notches arranged in a ring to receive the connector ring therein to retain the connector ring in a fixed position relative to the base plate.

6. The canopy of claim 2, wherein the rod connector further includes a base plate formed to include a plurality of notches arranged in a ring to receive the connector ring in a fixed position relative to the base plate.

7. The canopy of claim 6, wherein the base plate is formed to include four pairs of side walls, the side walls in each pair of side walls are arranged to lie in spaced-apart relation to one another to receive the inner end of one of the support rods therein, and each side wall is formed to include one of the plurality of notches.

8. The canopy of claim 2, wherein the rod connector further includes a rod mount formed to include a separate slot arranged to receive each of the inner ends of the support rods therein.

9. The canopy of claim 8, wherein the rod mount is formed to include a downwardly facing lip arranged to lie at an inner end of each separate slot and to engage the inner end of each support rod to restrain counterclockwise pivoting rotation of the inner ends of the support rods about the connector ring to allow bowing of the support rods relative to the rod mount during installation of the canopy support on a playyard yet allow clockwise pivoting rotation of the support rods about the connector ring during removal of the canopy support from a playyard.

10. The canopy of claim 8, wherein the rod mount includes a base plate and a top plate coupled to the base plate to trap the connector ring therebetween.

11. The canopy of claim 8, wherein the rod mount is formed to include notches to receive the connector ring therein to retain the connector ring in a fixed position relative to the rod mount.

12. The canopy of claim 11, wherein the rod mount includes a base plate and a top plate coupled to the base plate to trap the connector ring therebetween and the base plate is formed to include four pairs of side walls, the side walls in each pair of side walls are arranged to lie in spaced-apart relation to one another to define one of the separate slots therebetween, and each side wall is formed to include a notch receiving a portion of the connector ring therein.

13. A canopy for covering the top of a playyard, the canopy comprising a canopy cover and a canopy support adapted to be coupled to a playyard and configured to support the canopy cover, the canopy support includes four support rods, a rod mount including a bottom plate and a top plate coupled to the bottom plate, and a pivot apparatus trapped between the top and bottom plates and configured to pivotably couple inner ends of each of the four support rods to the rod mount for pivotable movement generally perpendicular to the plates from a spread position for supporting the canopy cover to a fully collapsed storage position, and a post connected to and terminating at one end to the rod mount and connected to and terminating at the other end to a vent tower support.

14. The canopy of claim 13, wherein the pivot apparatus includes a connector ring coupled to each of the inner ends of the four support rods.

15. The canopy of claim 14, wherein the base plate is formed to include notches and the connector ring is positioned to lie in the notches to fix the connector ring to the base plate.

16. A canopy for covering the top of a playyard, the canopy comprising a canopy cover, a collapsible canopy frame supporting the canopy cover and adapted to be coupled to a playyard, a vent tower coupled to a top portion of the canopy cover and including a ceiling and a mesh side wall, a collapsible vent tower frame arranged to support the vent tower including a leg connector, four side legs, and four top legs, a lower end of each side leg is pivotably coupled to the canopy frame, an outer end of each top leg is pivotably coupled to an upper end of a companion side leg, and an inner end of each top leg is pivotably coupled to the leg connector, and a post connected to and terminating at one end to the vent tower frame and at the other end to the canopy frame.

17. The canopy of claim 16, wherein the canopy frame includes a rod connector and four support rods pivotably coupled to the rod connector and each of the four side legs is pivotably coupled to one of the four support rods.

18. The canopy of claim 16, wherein the canopy support further includes a tower post arranged to interconnect the canopy frame and the tower frame.

19. A canopy for covering the top of a playyard, the canopy comprising a canopy cover, a vent tower coupled to a top portion of the canopy cover and having a collapsible frame arranged to support the vent tower, the vent tower including a ceiling and a mesh side wall, and a canopy support adapted to be coupled to a playyard, including a collapsible canopy frame supporting the canopy cover and a tower post arranged to interconnect the canopy frame and the tower frame, wherein the tower frame includes a leg connector, four side legs, and four top legs, a lower end of each side leg is pivotably coupled to the canopy frame, an outer end of each top leg is pivotably coupled to an upper end of a companion side leg, and an inner end of each top leg is pivotably coupled to the leg connector, the canopy frame includes a rod connector and four support rods pivotably coupled to the rod connector, each of the four side legs is pivotably coupled to one of the four support rods, and a top portion of the tower post is coupled to a bottom surface of the leg connector and a bottom portion of the tower post is coupled to a top surface of the rod connector.

* * * * *